US007007622B1

(12) United States Patent
Clark

(10) Patent No.: US 7,007,622 B1
(45) Date of Patent: Mar. 7, 2006

(54) ADJUSTABLE BOAT FENDERS SYSTEM

(76) Inventor: Debra Clark, 2262 25th Sideroad, Innisfil, Ontario (CA) L9S 2G2

( * ) Notice: Subject to any disclaimer, the term of this patent is extended or adjusted under 35 U.S.C. 154(b) by 0 days.

(21) Appl. No.: 10/928,583

(22) Filed: Aug. 30, 2004

(51) Int. Cl.
*B63B 59/02* (2006.01)

(52) U.S. Cl. ..... 114/219; 114/221 R; 114/364

(58) Field of Classification Search ..... 114/219, 114/220, 221 R, 293, 210, 230.2, 230.23, 114/230.24, 230.25, 230.26, 364; 188/65.1–65.5
See application file for complete search history.

(56) References Cited

U.S. PATENT DOCUMENTS 3,041,045 A * 6/1962 Bleiler ..... 254/280
3,292,566 A * 12/1966 Russell ..... 114/219
3,799,098 A * 3/1974 Taylor et al. ..... 114/294
4,074,649 A * 2/1978 Stranahan ..... 114/219
4,343,258 A * 8/1982 Belvedere ..... 114/219
4,579,077 A * 4/1986 Soules ..... 114/301
4,807,556 A * 2/1989 Hillier ..... 114/345
4,841,893 A * 6/1989 Ellison ..... 114/219
5,493,983 A * 2/1996 Hurt ..... 114/364
6,758,155 B1 * 7/2004 Nicholas ..... 114/219

FOREIGN PATENT DOCUMENTS

JP 56053980 A * 5/1981
JP 04331691 A * 11/1992

* cited by examiner

*Primary Examiner*—S. Joseph Morano
*Assistant Examiner*—Ajay Vasudeva
(74) *Attorney, Agent, or Firm*—David W. Wong

(57) ABSTRACT

An adjustable system is provided for remotely varying the vertical position of a plurality of boat fenders. The fenders are tied to elongated ropes which are threaded through pulley bars mounted on the guard rail of the boat. The end portion of the ropes are located at the rear side portion of the boat such that the ropes may be conveniently pulled or release to adjust the vertical position of the fenders simultaneously.

5 Claims, 3 Drawing Sheets

ADJUSTABLE BOAT FENDERS SYSTEM

FIELD OF THE INVENTION

This invention relates to a fenders system for a boat and more particularly relates to an adjustable system of providing a plurality of fenders around a boat such that the vertical position of the fenders may be varied from a remote location.

BACKGROUND OF THE INVENTION

Cylindrical shaped vinyl or polyvinyl fenders or fenders are commonly provided around the sides of a boat for absorbing the impact between the boat and the dock during docking. The fenders are hung by ropes tied to cleats mounted on the gunwale or deck of the boat. As the water level relative to a dock changes due to tide or due to different dock structures to which the boat may have to dock, it has been problematic to boaters of having to vary the vertical position of the fenders from time to time to compensate for such variations. Such task is difficult to carry out on the boat since one must climb onto the small footholds of the gunwale or the front deck to raise and adjust each bumper individually. Some boats are provided with only a narrow walkway around the gunwale; furthermore, the boat is usually in motion riding up and down on waves and the footholds and the deck may also be wet and slippery. This creates a potentially dangerous situation for the person climbing or walking around the gunwale or the deck of the boat to adjust the fenders and may fall or be thrown overboard in the process. It is even more dangerous to carry out in the rain or in a storm.

SUMMARY OF THE INVENTION

It is a principal object of the present invention to provide an adjustable system for boat fenders which is operative for varying the vertical position of the fenders.

It is another object of the present invention to provide an adjustable system which is operative without having to climb onto the gunwale or the deck of the boat.

It is another object of the present invention to provide an adjustable system which is operative remotely from a safe location in the boat.

It is another object of the present invention to provide an adjustable system which allows the positions of the fenders around the boat to be varied easily.

It is still another object of the present invention to provide an adjustable system which is simple in construction and easy to manufacture.

It is yet another object of the present invention to provide an adjustable system which is easy to operate.

Briefly, the system of the present invention comprises a plurality of pulley bars adapted for mounting along the guard rail of a boat. The pulley bars have a plurality of rotary wheels rotatably mounted therein. A plurality of elongated ropes having one end adapted to tie to a plurality of fenders individually are threaded through spacings between the rotary wheels of the pulley bars. The free end of the elongated ropes is located at a rear portion of the boat when the pulley bars are mounted on the boat. A fastener is adapted for securing the free end of the ropes on the boat. The fastener may be selectively operative for either latching the free end portion of the ropes to the boat or unlatching the free end portion of the ropes so that they may be pulled or released to raise or lower the fenders simultaneously, remotely and quickly.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
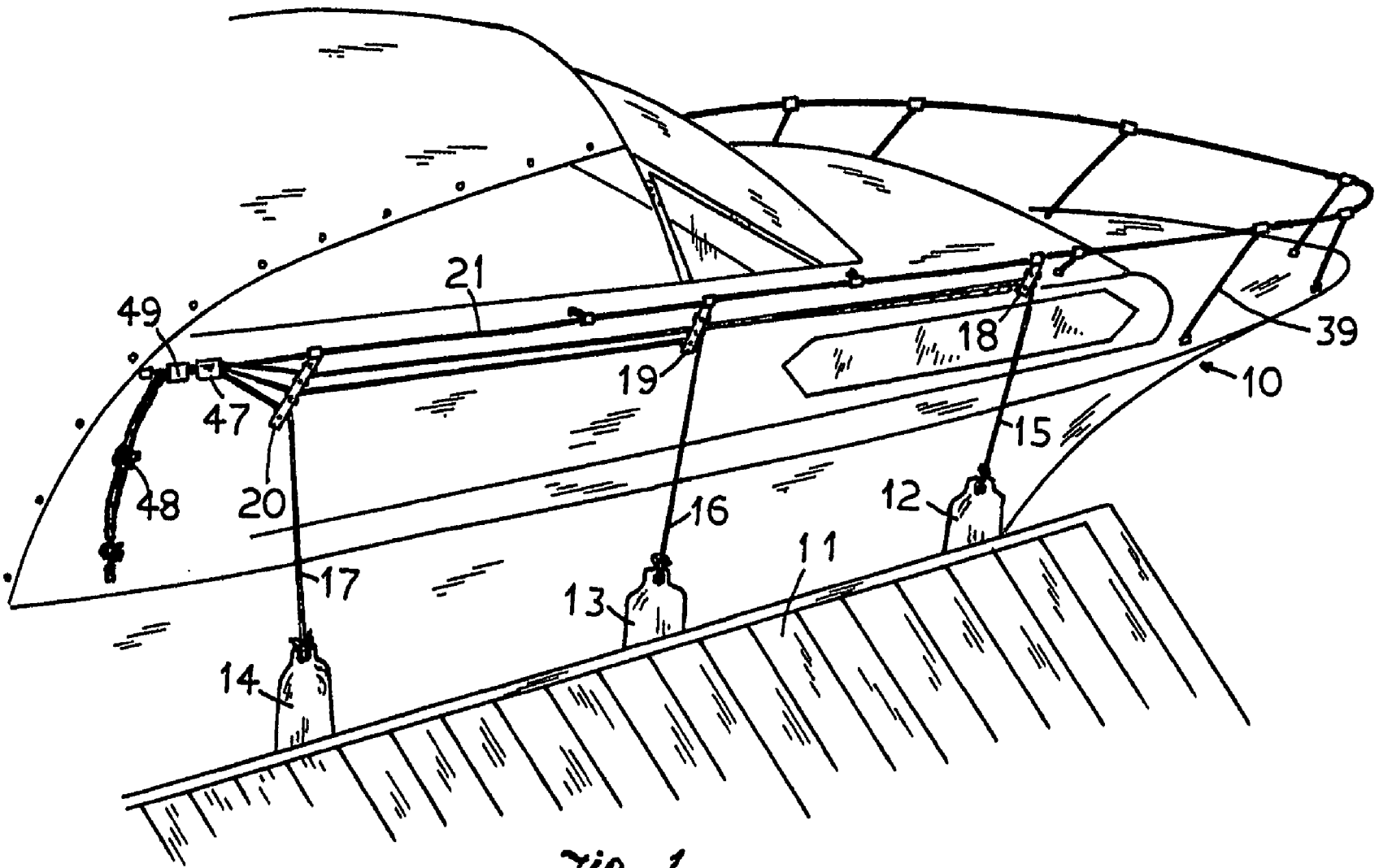
FIG. 1 is a perspective elevation view of a boat provided with the fenders system according to the present invention.
Figure 2:
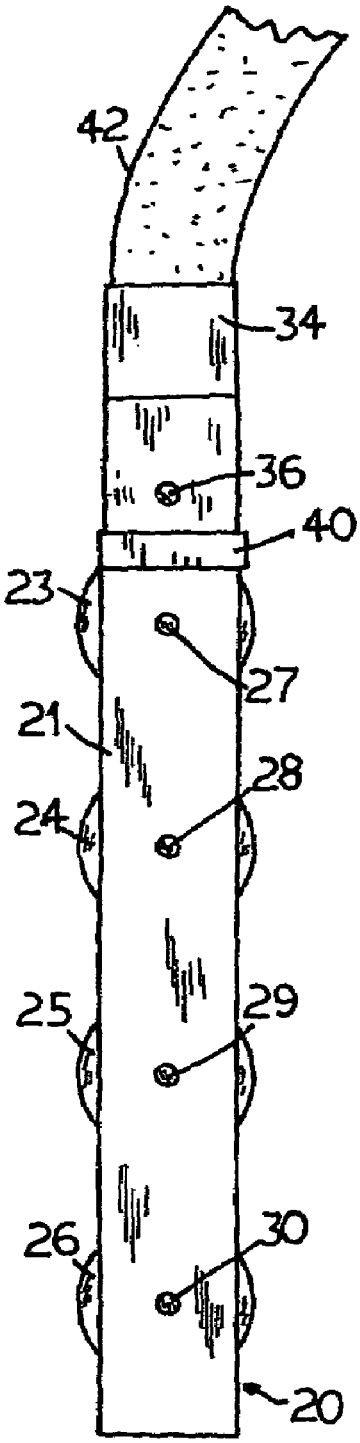
FIG. 2 is the front elevation view of one of the pulleys of the system according to the present invention.
Figure 3:
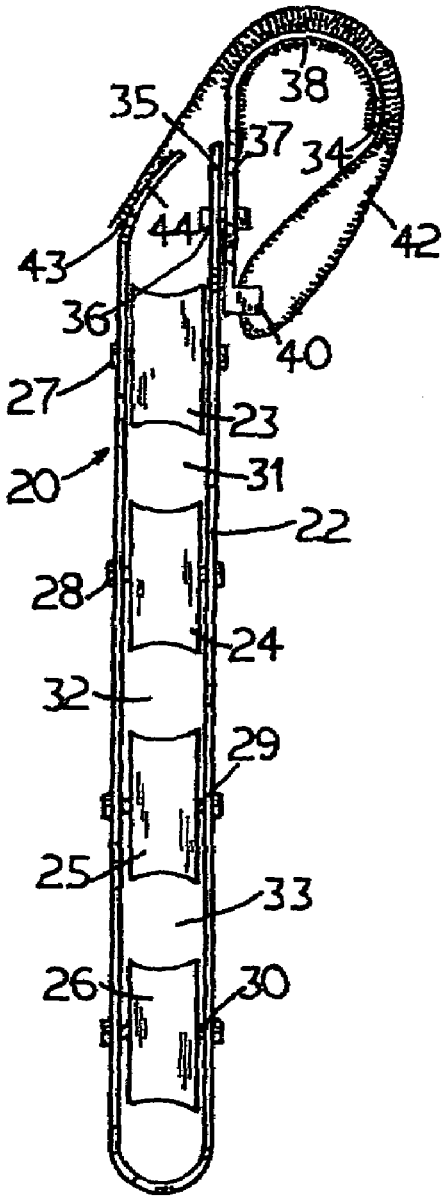
FIG. 3 is the side elevation view of the pulley of FIG. 2.
Figure 4:
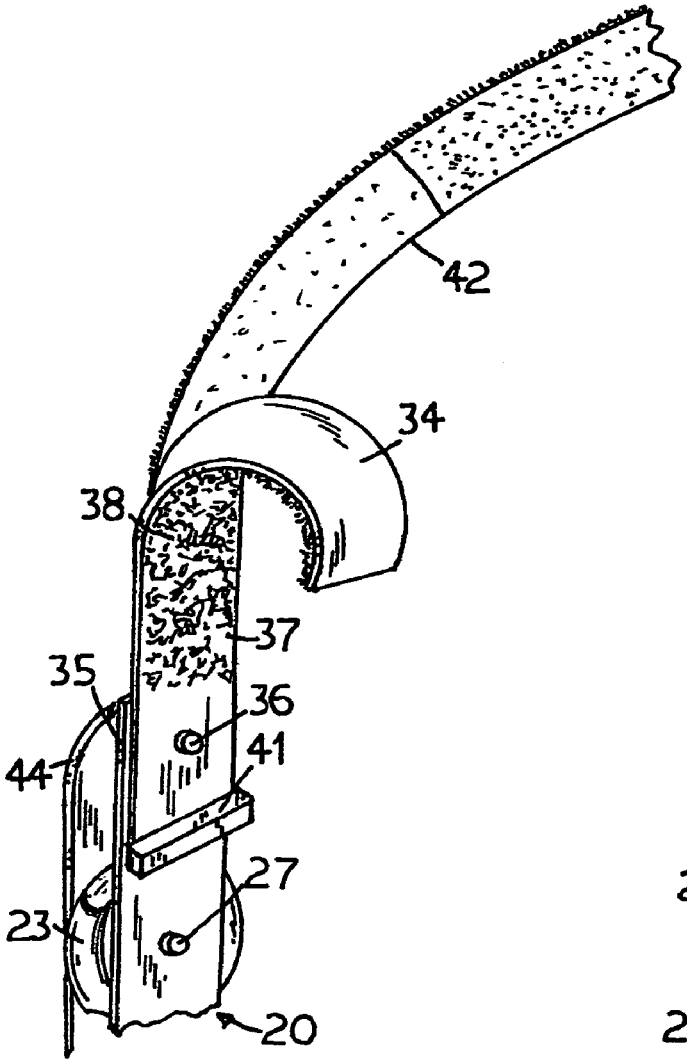
FIG. 4 is an isolated top elevation view showing the hook shaped bracket and the attachment strap of the pulley.

With reference to the drawings in which like reference numerals designate corresponding parts in the several different views, the boat 10 is shown moored at a dock 11, commonly several fenders are provided on the boat to absorb the impact during docking as well as during mooring as the water waves push the boat against the dock. For simplicity of illustration, three fenders 12, 13 and 14 are shown as an example. Normally, these fenders are tied with ropes of fixed lengths secured to cleats provided on the deck of the boat. According to the present invention, the fenders 12, 13 and 14 are tied to elongated ropes 15, 16 and 17 respectively which are routed through three pulley bars 18, 19 and 20 respectively. For the exemplary embodiment, the pulley bar 18 has two rotary wheels, the pulley bar 19 has three rotary wheels and pulley bar 20 has four rotary wheels and apart from the different number of wheels provided they have similar construction. The pulley bars 18, 19 and 20 may be mounted to the guard rail 21 of the boat as best shown in FIG. 1. Such guard rail is commonly provided on a medium and larger size pleasure boat. The four wheels pulley bar 20 is shown in FIGS. 2 and 3. The pulley bar 20 has an elongated substantially U-shaped main body 22. Four rotary wheels 23, 24, 25 and 26 are rotatably mounted on the main body 22 with shafts 27, 28, 29 and 30 respectively with rope routing spaces 31, 32 and 33 located between the rotary wheels. The rope 15, tied to the front fender 12, is routed through the space between the two rotary wheels of pulley bar 18 and the space between the top two rotary wheels of pulley bar 19 and pulley bar 20. The rope 16 tied to the middle fender 13 is routed through the bottom two rotary wheels of pulley bar 19 and the two middle rotary wheels of pulley bar 20, while the rope 17 tied to the rear fender 14 is routed through the bottom two rotary wheels of pulley bar 19 and the bottom two rotary wheels of pulley bar 20.

Figure 5:
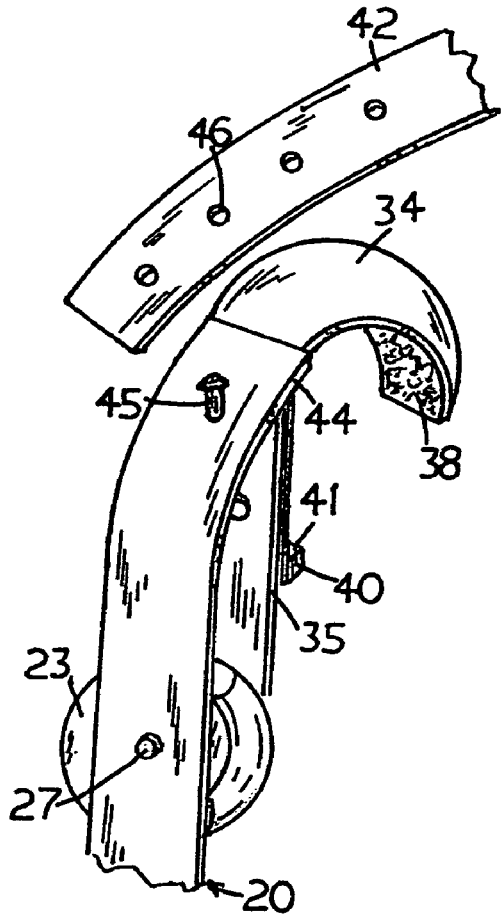
FIG. 5 is an isolated enlarged side elevation view of the rear plate of the pulley bar showing the alternative provision of catch pin thereon for securing the end portion of the strap.

Each pulley bar has a circular hook-shaped bracket 34 pivotally mounted to the top end portion of its front plate 35 by a pin 36 to facilitate mounting the pulley bar to the guard rail 21 of the boat 10. The inside surface 37 of the hook-shaped bracket 34 is lined with cushioning material 38 such as a fuzzy fabric so as to enhance the securement of the pulley bar to the guard rail 21 of the boat. The bracket 34 is pivotable sideways relative to the front plate 35 so that it may pivot at an angle during operation to enhance the rotational movement of the rotary wheels; moreover, it facilitates the pulley bar to be mounted alternatively and selectively on any vertical support post 39 of the guard rail 21 or a similar vertical post for a boat having a different guard rail design. A rectangular buckle 40 having a rectangular opening 41 is provided at the lower edge portion of the hook-shaped bracket 34. An elongated strap 42 is mounted at one end portion therein between the hook-shaped bracket 34 and the front plate 35 of the main body 22. The strap 42 has a width slightly smaller than the width of the rectangular opening 41 of the buckle 40 so that it may be threaded through the buckle 40 to secure the pulley bar tightly on the guard rail 21 or the other vertical post 39 on the boat. Fuzzy securement material such as Velcro (a trademark) may be provided on both the outer surface as well as the inside surface of the strap 42 so that the fuzzy securement material on the engaging surfaces may be attached to one another firmly after the strap 42 has looped through the buckle 40 as best shown in FIG. 3. Same fuzzy securement material 43 is also provided on the surface of the top portion of the rear plate 44 for attaching the end of the strap 42 securely to the rear plate 44 by engaging the two fuzzy surfaces. Alternatively, as shown in FIG. 5 a catch pin 45 may be provided on the rear plate 44, and a series of holes 46 are formed in the strap 42 so that the end of the strap may be secured to the rear plate 44 by engaging a selected hole 46 with the catch pin 45. With the above provision, the pulley bars 18, 19 and 20 may be quickly and easily mounted at any selected positions on the guard rail 21 or other vertical support posts.

All three ropes 15, 16 and 17 after having threaded through the pulley bars 18, 19 and 20 are joined together to pass through a guide sleeve 47 mounted on the guard rail 21. The end portion of the ropes may be tied together with a knot 48 and they may also be fastened to the guard rail 21 with a Velcro (a trademark) strap 49. The end portion of the ropes are located at the open rear side of the boat such that the joined ropes may be easily accessible by the boater for remotely raising or lowering the fenders 12, 13 and 14 simultaneously, expeditiously, and conveniently to any required vertical position by undoing the securing strap 49 and pulling or releasing the ropes and then securing the fenders at the selected position by securing the end portion of the ropes again with the securing strap 49.

The pivotable mounting of the bracket 34 to the front plate 35 of the pulley bar enables the pulley bars 18, 19 and 20 to pivot to enhance the operation of the raising or lowering of the fenders 12, 13, and 14 while pulling or releasing the ropes 15, 16 and 17. Also, the pivotable mounting permits the pulley bar to be mounted alternatively on any post other than a horizontal guard rail, which may be provided in numerous different boat designs.

While the preferred embodiments of the invention have been described above. It will be recognized and understood that various modifications may be made therein and the appended claims are intended to cover all such modifications which may fall within the spirit and scope of the invention.

I claim:

1. A system of mounting a plurality of fenders to a side of a boat comprising:

a plurality of pulley bars mounted to guard rails along said side of said boat, said pulley bars having a plurality of rotary wheels mounted rotatably in an elongated U-shaped main body having a front plate and a rear plate;

a hook-shaped bracket pivotally mounted at a top end portion of said front plate, said hook-shaped bracket engaged with said guard rail for mounting said pulley bars thereto;

a plurality of elongated ropes having one end tied to said fenders individually and being threaded through spacings between said rotary wheels of said pulley bars, a free end of said ropes being located at a rear portion of said boat;

a fastener secured to said free end portion of said ropes on said boat, said fastener being selectively operative for latching said free end portion of said ropes to said boat and unlatching said free end portion of said ropes whereby said fenders are adjustable to any selected vertical position by selectively pulling and releasing said ropes.

2. A system according to claim 1 including a buckle provided on said book-shaped bracket, said buckle having a rectangular opening, and an elongated strap mounted to said hook-shaped bracket, said strap being operative to engage with said buckle through said rectangular opening for mounting said pulley bar to said guard rail of said boat.

3. A system according to claim 2 including a fuzzy mounting material provided on an inside surface and an outer surface of said strap and being operative for securing said strap tightly after having threaded through rectangular opening of said buckle.

4. A system according to claim 2 including a mounting pin provided on said rear plate of said pulley bar and a plurality of holes formed in an end portion of said strap, and mounting pin and said holes engageable with one another for securing said strap tightly for mounting said pulley bar to said guard rail.

5. A system of mounting a plurality of impact absorbing fenders along a side of a boat comprising:

a plurality of pulley bars pivotally mounted on a guard rail of said boat, said pulley bars having a plurality of rotary wheels therein;

a hook-shaped bracket pivotally mounted to a top portion of each one of said pulley bars, said bracket mounting said pulley bars on selected posts on said boat;

an elongated strap mounted on each one of said pulley bars and operative for retaining said pulley bars securely mounted on said posts;

a plurality of elongated ropes with one end of each one rope tied to each one of said fenders individually, said ropes being threaded through spacings between said rotary wheels of said pulley bars and having a free end portion extending to a rear portion of said boat;

a guide sleeve located at said rear portion of said boat guiding said ropes in a bundle manner to extend to said rear portion of said boat;

a fastener located at said rear portion of said boat securing said free end portion of said ropes on said boat, said fastener being selectively operative for latching said free end portion of said ropes to said boat and unlatching said free end portion of said ropes whereby said ropes are operative for adjusting said fenders simultaneously to any selected vertical position.

* * * * *